United States Patent [19]

Carbonell et al.

[11] 4,020,998

[45] May 3, 1977

[54] METHOD AND APPARATUS FOR WINDING BOBBINS

[75] Inventors: José Carbonell, Bottmingen; Rolf Hasler, Oberwil, both of Switzerland; Roland Walliser, Rixheim, France

[73] Assignee: Sandoz Ltd., Basel, Switzerland

[22] Filed: Jan. 30, 1975

[21] Appl. No.: 545,334

[30] Foreign Application Priority Data

Feb. 5, 1974 United Kingdom ..... 5174/74
Dec. 17, 1974 United Kingdom ..... 54384/74

[52] U.S. Cl. ..... 242/39; 242/45; 242/49; 242/57; 242/75.2; 242/75.5

[51] Int. Cl.[2] ..... B65H 63/08; B65H 59/00

[58] Field of Search ..... 242/39, 36, 18 R, 45, 242/47, 49, 57, 62, 67.1 R, 67.5, 75.2, 75.5; 68/150

[56] References Cited

UNITED STATES PATENTS

| | | | |
|---|---|---|---|
| 2,252,419 | 8/1941 | Slaughter | 242/75.45 |
| 2,750,921 | 6/1956 | Purdy | 242/75.45 X |
| 2,947,489 | 8/1960 | Russell | 242/18 R |
| 3,312,414 | 4/1967 | Knapp | 242/75.2 |
| 3,386,679 | 6/1968 | Foulon et al. | 242/75.2 X |
| 3,595,492 | 7/1971 | Furst | 242/75.2 X |

*Primary Examiner*—Stanley N. Gilreath
*Attorney, Agent, or Firm*—Gerald D. Sharkin; Richard E. Vila; Thomas C. Doyle

[57] ABSTRACT

The present invention concerns a novel method of winding bobbins having a predetermined radial fluid permeability which comprises winding yarn or fabric on a hollow permeable core, passing a fluid radially through the windings on the core and terminating the winding when a predetermined fluid pressure is attained, and an apparatus therefor.

Said method and apparatus enable "bobbins" to be uniformly dyed.

14 Claims, 2 Drawing Figures

METHOD AND APPARATUS FOR WINDING BOBBINS

Figure 1:
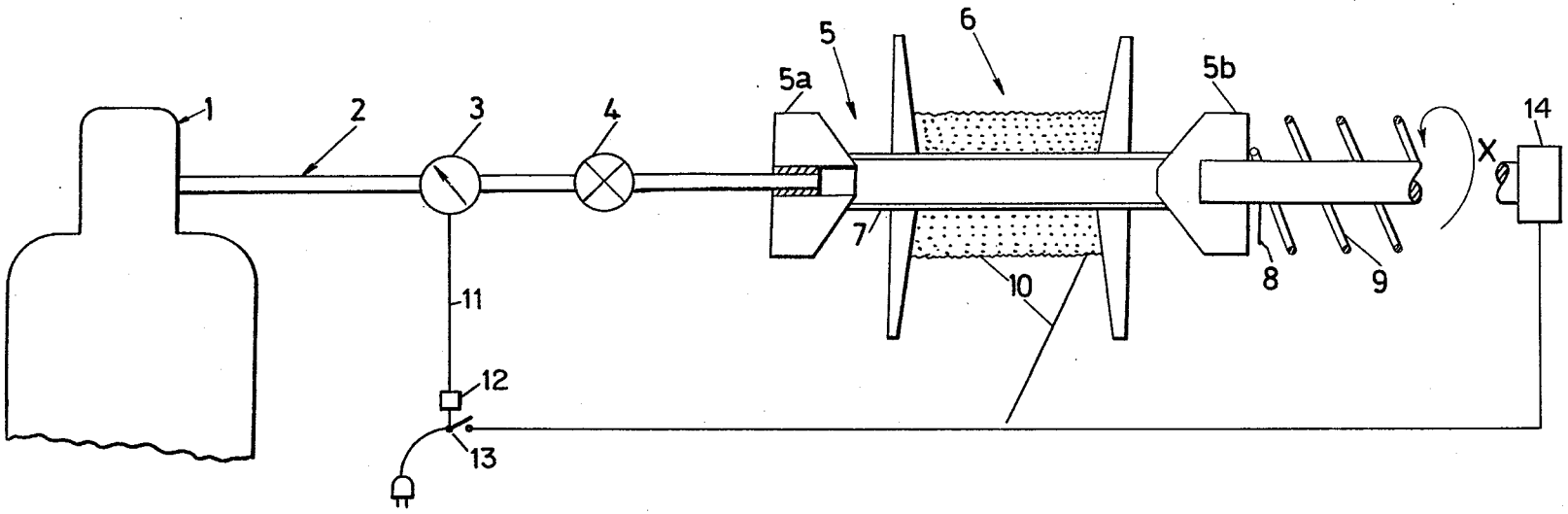

The present invention relates to yarn or fabric winding machines and more specifically to machines employed in the production of yarn or fabric bobbins wherein the yarn or fabric is wound on a hollow permeable core, e.g. a hollow perforated spindle or a spring sleeve.

In the dyeing of yarn or fabric in a circulating machine, i.e. a machine wherein the dye liquor is circulated through the yarn or fabric, the yarn or fabric is in general employed in the form of a bobbin. The term bobbin, as employed herein, is used in a broad sense to embrace all forms of yarns or fabric when wound on a permeable core. Thus, when dyed in a circulating machine, dye liquor is passed through the hollow permeable core and radially outwardly through the windings of the bobbin yarn or fabric and/or vice versa. Such bobbins are referred to in the art by many terms, e.g. cops, cones, cheeses, cakes, packages and beams, depending on the exact form of the bobbin and the circulating machine for which they are adapted, e.g. cop, cone, cheese, cake, package and beam dyeing machines. A common disadvantage in the dyeing of all the above-mentioned types of bobbins however, especially when a plurality of bobbins are dyed together, e.g. in stacks such as dyed in a cheese dyeing machine, is the occurrence of non-uniform dyeing, either between the different bobbins in a stack, or between different batches of bobbins. When dyeing the bobbins in stacks, for example, much research has been invested to ensure that a uniform supply of dye liquor reaches each of the bobbins in a stack and modifications in dyeing machines have been accordingly made. However, dye liquor supply is only one of the factors that affect the non-uniform dyeing of bobbins. Another and important factor is the permeability of the bobbins with respect to the dye liquor. Thus, it has been found that bobbins having substantially the same radial fluid permeability may be uniformly dyed given the same dye liquor supply.

Accordingly, the present invention provides a method of winding "bobbins" having a predetermined radial fluid permeability which comprises winding yarn or fabric on a hollow permeable core, passing a fluid radially through the windings on the core and terminating the winding when a predetermined fluid pressure is attained.

The present invention also provides a winding machine for winding bobbins having a predetermined radial fluid permeability which comprises means for winding yarn or fabric on a hollow permeable core, a fluid conduit adapted to sealingly engage the core on which the yarn or fabric is to be wound to permit passage of fluid radially through the windings on the core and fluid pressure sensing means adapted to sense a predetermined fluid pressure whereupon winding of the bobbin may be terminated.

The present invention also provides bobbins whenever produced by the method or machine of the invention.

Preferably, a winding machine cut off means is included cooperable with the fluid pressure sensing means automatically to terminate winding when the predetermined fluid pressure is attained.

In general, the fluid employed is preferably in gaseous form, e.g. nitrogen or air, although liquid fluids, e.g. water or other dye liquor solvent or dispersion media are also contemplated.

The fluid may be passed radially outwardly or inwardly through the windings.

The fluid pressure sensing means is disposed in the fluid conduit and may either monitor pressure over the complete operating range as for example with a gas manometer having, e.g. a visual pressure display, or alternatively may comprise a pressure module sensitive only to the predetermined fluid pressure, at which pressure, a mechanical or electrical signal is emitted, which may either be employed in a visual pressure display, or, preferably, to operate a winding machine cut off means, as above-mentioned, e.g. by throwing the power source switch of the winding machine.

Permeability regulating means may be included to regulate one or more of the parameters determining the radial permeability of the windings during the winding process. In this manner the radial permeability of the windings on the core may be influenced.

Thus, according to one form of the invention, the fluid pressure sensing means monitors the fluid pressure over the complete operating range and cooperates with a data processing unit which controls a permeability regulating means. The permeability regulating means is adapted to regulate one or more of the parameters determining the radial permeability of the windings on the bobbin core. In particular the permeability regulating means is adapted to regulate the tension of the windings applied to the core, e.g. by regulating the speed of rotation of the core and/or by regulating the take-up resistance of the yarn or fabric being wound on the core.

The data processing unit is employed to provide feedback to the permeability regulating means dependent on the monitored fluid pressure.

In one embodiment of this form of the invention, the data processing unit is adapted to compare the monitored fluid pressure with a predetermined fluid pressure template as a function of winding time, radial depth of the windings or the number of windings on the core, and control the permeability regulator means, e.g. to regulate the yarn or fabric tension, accordingly. In this manner, bobbins may be produced which not only correspond in overall fluid permeability but also in the manner in which the permeability varies radially of each "bobbin" to ensure that a constant level of dyeing is obtained as between the various windings on a bobbin. This embodiment is of particular importance to fabric bobbins, e.g. to beams.

In another embodiment of this form of the invention, the data processing unit also cooperates with a size sensor which measures the radial size of the bobbin during the winding process. The data processing unit is adapted to compare the monitored fluid pressure and size with a predetermined fluid pressure and size and to control the permeability regulator means to ensure that bobbins of a predetermined size will have a predetermined fluid pressure. This embodiment therefore obviates the need of sorting bobbins into various sizes before dyeing.

The hollow permeable core, e.g. a hollow perforated spindle, may conveniently be of the type conventionally employed for the winding of bobbins or may be specifically adapted, e.g. by having one end thereof sealed. In the case wherein a core of conventional type is employed, end plugs are employed one of which being adapted to receive the fluid conduit in sealing engagement therewith. Such end plugs may form part of the apparatus of the invention, the bobbin holder of the winding machine comprising, e.g. a pair of mutually spring loaded frustroconical plugs, one of said plugs being a drive means to the core to cause winding rotation thereof and the other being rotable with the core and adapted to receive the fluid outlet of the fluid conduit in sealing engagement. Said end plugs are conveniently constructed of high friction flexible material such as rubber, the plug connected to the fluid conduit being provided with a seal in the form of a bush or bearing in the plug to accomodate the fluid conduit, e.g. a polytetrafluoroethylene bush being provided with sealing gaskets.

Figure 2:
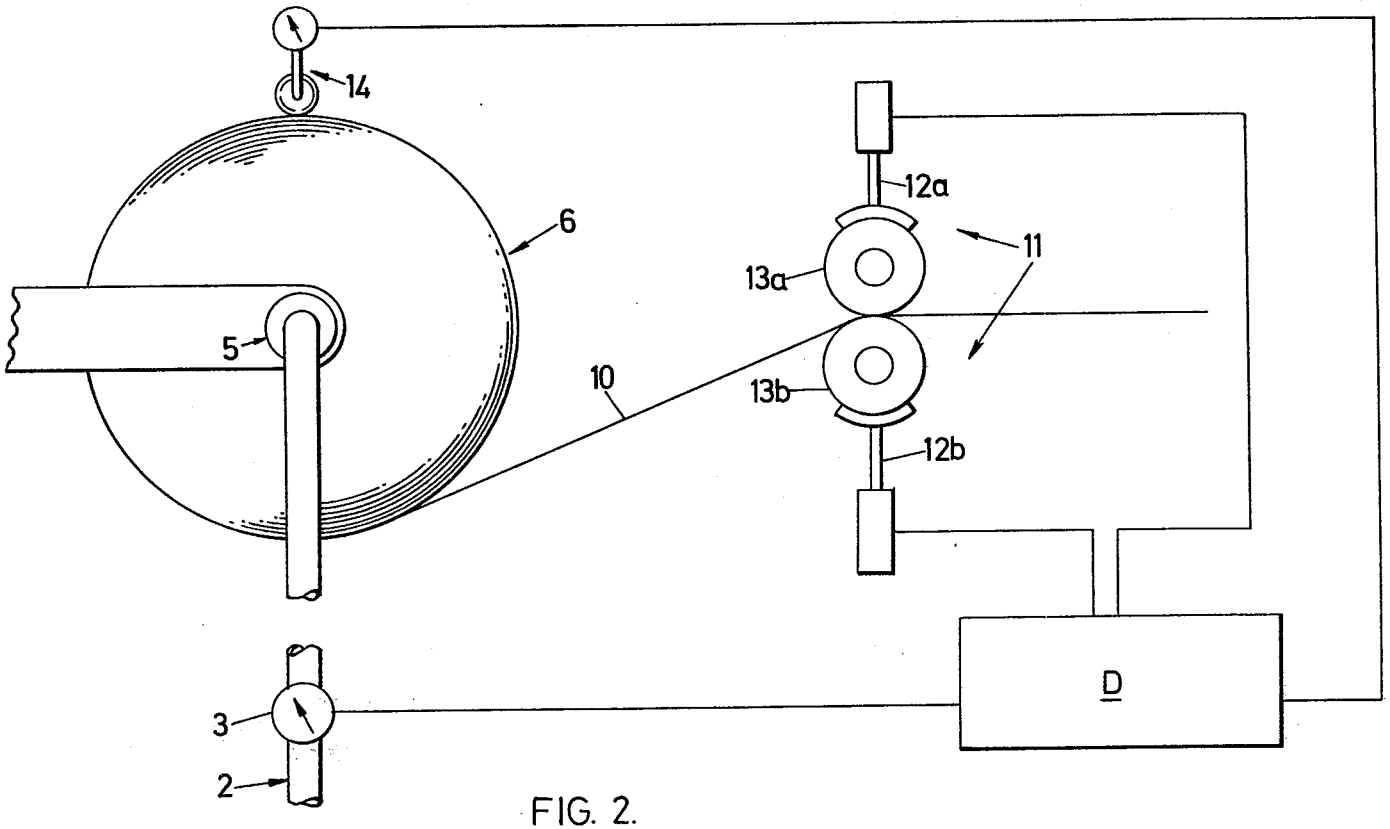

Embodiments of the invention will now be described by way of example with reference to the accompanying drawings wherein FIG. 1 is a diagrammatic part axial sectional view through part of a yarn winding machine, and FIG. 2 is a diagrammatic side view of a fabric winding machine.

The winding machine represented in FIG. 1 of the drawings comprises a precision winding machine of conventional construction adapted to produce yarn bobbins.

The winding machine is characterized by a fluid conduit 2 connected at one end to a nitrogen gas supply 1. The fluid conduit 2 is provided with a gas manometer 3, adapted to give a visual pressure display and a tap 4. The end of the fluid conduit 2 remote from the gas supply 1 is accommodated in a gas-tight bearing in one of a pair of bobbin holders 5 relative to the fluid conduit 2 in a gas-tight manner. The bobbin holder 5*a* is provided with a coaxial bore to permit gas communication between the fluid conduit 2 and core, in the form of a hollow perforated spindle 7, of a bobbin 6, disposed between the bobbin holders 5. The bobbin holder 5*b* is solid and shaped to engage with and seal one end of the spindle 7 of the bobbin 6 disposed between the bobbin holders 5. The bobbin holder 5*b* is provided with a drive shaft 8 and is spring loaded by compression spring 9 relative to the bobbin holder 5*a* in order effectively to seal and grip the spindle 7 of the bobbin, to enable drive to be transmitted from a suitable drive means through the drive shaft 8 to the bobbin 6 and bobbin holder 5*a*, the gas-tight bearing of bobbin holder 5*a* enabling rotation of the bobbin holders 5 and bobbin 6 while maintaining gas-tight communication with the fluid conduit 2. Manometer 3 is connected via line 11 to solenoid 12 in known manner for opening power source switch 13 to cut off power to conventional means, such as variable speed motor 14, for driving drive shaft 8. As indicated above, the speed of rotation may be regulated during the winding process. As will be apparent, this can be accomplished by manual control of the variable speed motor or, as also indicated above, through control by a data processing unit.

In operation of the precision winding machine described above, gas is admitted from the gas supply to the interior of the hollow spindle via the fluid conduit 2 and bobbin holder 5*a*, escaping through the perforations in the hollow spindle 7, and, simultaneously, drive is transmitted through drive shaft 8 and bobbin holders 5 to the spindle 7. On rotation of the spindle, winding is proceeded with in conventional manner, the increasing convolutions of yarn 10 on the spindle 7 of the bobbin 6 obstructing the flow of gas radially outwardly from the bobbin and being registered as a pressure increase on the gas manometer 3. Winding is continued until a predetermined pressure is recorded on the manometer 3 whereupon winding is terminated, as by actuation of switch 13, and the wound bobbin removed.

Proceeding in the aforedescribed manner with other bobbins, bobbins of yarn are produced having substantially uniform permeability.

On dyeing the bobbins so obtained in a circulating dyeing machine, it is found that a satisfactory level of uniformity is obtained not only between bobbins dyed in single batch, but also between bobbins of different batches.

The winding machine represented in FIG. 2 of the drawings comprises a machine for producing fabric bobbins in the form of beams.

The mounting and gas supply to the bobbin being wound, in this instance a beam, is similar in lay out and operation to that described in relation to the embodiment shown in FIG. 1. Thus the core (not shown) of the beam 6 is connected to a nitrogen gas supply (not shown) via a fluid conduit 2 provided with a manometer 3, the conduit 2 entering the beam core via beam holder 5. The core, as in the embodiment shown in FIG. 1, comprises a perforated hollow spindle.

The winding machine of FIG. 2 also comprises a beam size sensor 14, adapted to monitor the increasing diameter of the beam, a fabric tensioning unit 11, adapted to controllably adjust the take up resistance of the fabric 10 to winding and data processing unit D.

The beam size sensor 14, comprises a roller restricted to move radially of the beam, the degree of radial movement being monitored as an electrical signal.

The fabric tensioning unit 11 comprises a pair of cooperating rolls 13*a* and 13*b*, the fabric 10 passing through the nip therebetween. The movement of the rolls 13*a* and 13*b* is controllably variable by braking systems 12*a* and 12*b*, each of which braking systems being solenoid operated, the extent of braking and hence the extent of take up resistance of the fabric therebetween being dependent of the electrical current passing to the solenoids.

The data processing unit D is of conventional form and is provided with data inputs from the manometer 3 and size sensor 14 and a signal output via an amplifier circuit (not shown) to the solenoids of braking systems 12*a* and 12*b*. The data processing unit is programmed to process the incoming beam size and permeability data from the size sensor 14 and manometer 3 and to compute therefrom the beam permeability at the predetermined size of the beam and compare the computed permeability with the predetermined permeability. The data processing unit also carries a response programme designed to control the tensioning unit 11 in response to permeability deviation as between the computed and predetermined values, thereby to compensate the permeability of the beam for any anticipated deviation from the predetermined value at the predetermned size. As will be appreciated, the system effectively provides for feed-back from the size sensor and manometer to the tensioning units and accordingly, in operation of the winding machine, a beam will be produced of predetermined size and permeability.

What is claimed is:

1. A method of winding bobbins having a predetermined radial fluid permeability which comprises winding yarn or fabric on a hollow permeable core, passing a fluid radially through the windings on the core during winding of the yarn or fabric onto the core, the fluid pressure within the core changing due to the yarn or fabric winding onto the core, and terminating the winding when a predetermined fluid pressure is attained in the core.

2. A method according to claim 1, wherein the fluid is a gas.

3. A method according to claim 1, wherein the fluid is passed radially outwardly through the windings.

4. A method according to claim 1, wherein the bobbin comprises a cop, cone, cheese, cake, package or beam.

5. A method according to claim 1, which comprises the further step of regulating the speed of rotation of the core to control the tension of the windings on the core.

6. A method according to claim 1 which comprises the further step of regulating the take-up resistance of the yarn or fabric to control the tension of the windings on the core.

7. A method according to claim 6 which comprises the further steps of monitoring the radial size of the bobbin and the fluid pressure at the core during the winding process and comparing said monitored values with predetermined values by means of a data processing unit and wherein the take-up resistance of the yarn or fabric is regulated in such manner as to bring the monitored fluid pressure into agreement with the predetermined pressure for a given radial size of bobbin.

8. A winding machine for winding bobbins having a predetermined radial fluid permeability which comprises means for winding yarn or fabric on a hollow permeable core, a fluid conduit adapted at one end to sealingly engage the core on which the yarn or fabric is to be wound and adapted at its other end to engage means for causing passage of fluid through the fluid conduit and radially through the windings on the core during winding of the yarn or fabric onto the core, fluid pressure sensing means for sensing a predetermined fluid pressure in the core during said winding and means for terminating the winding when said predetermined fluid pressure is reached.

9. A winding machine according to claim 8, wherein the terminating means comprises a cut-off means cooperable with the fluid pressure sensing means automatically to terminate winding when the predetermined fluid pressure is attained.

10. A winding machine according to claim 8, wherein the fluid conduit is connected to a gas supply so that the gas passes radially outwardly through the windings.

11. A winding machine according to claim 8, including a permeability regulating means comprising means for regulating the rotational speed of the core.

12. A winding machine according to claim 8, wherein the bobbin comprises a cop, cone, cheese, cake, package or beam.

13. A winding machine according to claim 8 including means for regulating the take-up resistance of the yarn or fabric to regulate during the winding process one or more of the parameters determining radial permeability of the windings.

14. A winding machine according to claim 13 which includes a data processing unit cooperable with the fluid pressure sensing means to control the means for regulating the take-up resistance of the yarn or fabric.

* * * * *